US005447193A

United States Patent [19]

Peery

[11] Patent Number: 5,447,193

[45] Date of Patent: * Sep. 5, 1995

[54] APPARATUS FOR INJECTING A VOLUME OF LIQUID INTO A LIQUID-CONDUCTING SYSTEM

[75] Inventor: Moshe Peery, Kibbutz Yotvata, Israel

[73] Assignee: C.Q.M. Ltd., Rishon Lezion, Israel

[ * ] Notice: The portion of the term of this patent subsequent to Feb. 14, 2012 has been disclaimed.

[21] Appl. No.: 258,888

[22] Filed: Jun. 13, 1994

Related U.S. Application Data

[63] Continuation-in-part of Ser. No. 154,062, Nov. 18, 1993, Pat. No. 5,388,636.

[51] Int. Cl.[6] ..... F28G 1/12

[52] U.S. Cl. ..... 165/95; 15/3.51

[58] Field of Search ..... 165/95; 15/3.5, 3.51, 15/104.062

[56] References Cited

U.S. PATENT DOCUMENTS

| | | | |
|---|---|---|---|
| 3,872,920 | 3/1975 | Honma et al. | 165/95 |
| 3,919,732 | 11/1975 | Honma et al. | 15/3.51 |
| 3,978,917 | 9/1976 | Honma et al. | 165/95 |
| 4,544,027 | 10/1985 | Goldberg et al. | 165/95 |
| 4,569,097 | 2/1986 | Echols | 15/104.062 |

FOREIGN PATENT DOCUMENTS

| | | | |
|---|---|---|---|
| 1247359 | 8/1967 | Germany | 165/95 |
| 14190 | 1/1982 | Japan | 165/95 |
| 356697 | 12/1992 | Japan | 165/95 |

*Primary Examiner*—Martin P. Schwadron
*Assistant Examiner*—L. R. Leo
*Attorney, Agent, or Firm*—Mark M. Friedman

[57] ABSTRACT

A cleaning system for cleaning liquid-conducting tubing including a plurality of balls, ball recirculation apparatus for recirculating balls and liquid recirculation apparatus for recirculating the liquid used for entraining the balls to the ball recirculation apparatus. The ball recirculation apparatus has an inlet at the downstream side of the tubing and an outlet at the upstream side of the tubing. The liquid recirculation apparatus has an inlet in flow communication with the ball recirculation apparatus and an outlet at the upstream side of the tubing. Also, an apparatus for injecting a volume of liquid from a source of liquid into a liquid conducting system including a compressor.

12 Claims, 5 Drawing Sheets

APPARATUS FOR INJECTING A VOLUME OF LIQUID INTO A LIQUID-CONDUCTING SYSTEM

The present application is a Continuation-in-Part of U.S. patent application Ser. No. 08/154,062 filed Nov. 18, 1993 now U.S. Pat. No. 5,388,636.

FIELD AND BACKGROUND OF THE INVENTION

The present invention relates to systems using balls for cleaning the inside of liquid-conducting tubing in condensers and other forms of heat exchangers in general and in particular to recirculation apparatus incorporated within such systems. The present invention also relates to apparatus for injecting a volume of liquid into a liquid conducting system in general, and in particular to apparatus for injecting a volume of liquid including a compressor.

Systems using balls for cleaning the inside of liquid-conducting tubing for preventing the build-up of coatings or any other fouling inside the tubing are known in the art. Such systems include ball recirculation apparatus for recirculating the balls through the tubing having an inlet at the downstream side of the tubing and an outlet at the upstream side of the tubing. Separation apparatus deployed between the downstream side of the tubing and the inlet to the ball recirculation apparatus separates the balls after each pass through the tubing for delivery to the ball recirculation apparatus.

It is well known that considerable volumes of liquid are discharged as waste during the delivery of the balls to ball recirculation apparatus. Rather than wasting quantities of water on each cycle of the balls passing through the system, there is thus a widely recognized need for, and it would be highly advantageous to have a low cost, simple and efficient liquid recirculation apparatus for recirculating the liquid entraining the balls to the ball recirculation apparatus to the main system.

Typically, pumps are employed for injecting a volume of liquid into a liquid conducting system. Selection of the appropriate pump is typically based on evaluating a number of factors including the head of the system, the volume of liquid to be recycled, etc. However, regardless of the actual pump implemented, it is well known that pumps are costly in terms of their initial outlay, their operating costs, maintenance costs, etc.

Therefore, there is thus a widely recognized need for, and it would be highly advantageous to have a low cost, simple and efficient apparatus for injecting a volume of liquid into a liquid conducting system.

SUMMARY OF THE INVENTION

The main object of the present invention is for liquid recirculation apparatus for integration with systems using balls for cleaning the inside of liquid-conducting tubing in condensers and other forms of heat exchangers, thereby preventing the waste of water used for delivering the balls to ball recirculation apparatus.

Another object of the present invention is for a low cost, simple and efficient apparatus for injecting a volume of liquid into a liquid conducting system.

Hence, according to the first aspect of the present invention, there is provided a cleaning system for cleaning liquid-conducting tubing, comprising: (a) a plurality of balls; (b) ball recirculation apparatus for recirculating at least a portion of the plurality of balls, the ball recirculation apparatus having an inlet at the downstream side of the tubing and an outlet at the upstream side of the tubing; and (c) liquid recirculation apparatus for recirculating at least a portion of the at least a portion of the liquid drained from the ball recirculation apparatus, the liquid recirculation apparatus having an inlet in flow communication with the ball recirculation apparatus for receiving at least a portion of liquid used for entraining the at least a portion of plurality of balls to the ball reciprocation apparatus and an outlet at the upstream side of the tubing.

Hence, according to a first aspect of the present invention, there is provided a cleaning system for cleaning liquid-conducting tubing, comprising: (a) a plurality of balls; (b) ball recirculation apparatus having an inlet at the downstream side of the tubing for receiving liquid entraining a portion of the plurality of balls, a ball outlet at the upstream side of the tubing, and a drain liquid outlet for draining some of the liquid entraining the portion of the plurality of balls, the ball recirculation apparatus recirculating some of the portion of the plurality of balls upstream of the tubing via the ball outlet; and (c) liquid recirculation apparatus having an inlet in flow communication with the drain liquid outlet for receiving a fraction of the liquid entraining the portion of the plurality of balls to the ball reciprocation apparatus and an outlet at the upstream side of the tubing, the liquid recirculation apparatus recirculating some of the fraction of the liquid drained from the ball recirculation apparatus upstream of the tubing via the outlet.

According to further features of the present invention, the liquid recirculation apparatus includes a compressor for selectively providing a supply of compressed air combined with a tank having: (i) a liquid inlet selectively in flow communication with the ball recirculation apparatus, (ii) a liquid outlet selectively in flow communication upstream of the tubing, (iii) an air inlet pipe selectively in flow communication with the compressor, and (iv) a pressure release valve for selectively decreasing the pressure prevailing within the tank.

According to still further features, the tank includes a funnel with a downwardly depending tube in which the funnel is disposed substantially toward the top of the tank while the tube extends downwards so as to be substantially adjacent the bottom of the tank. The system can also include sensing apparatus for sensing the level of the volume of liquid in the tank.

There is also provided according to a second aspect of the present invention, apparatus for injecting a volume of liquid received from a source of liquid into a liquid conducting system, the apparatus comprising: (a) a compressor for selectively providing a supply of compressed gas; and (b) a tank including: (i) a liquid inlet port selectively in flow communication with the source of the liquid for receiving a volume of liquid, (ii) a liquid outlet port selectively in flow communication with the liquid conducting system for delivering at least a portion of the volume of liquid, (iii) an air inlet selectively in flow communication with the compressor for increasing the prevailing pressure in the tank so as to discharge the at least a portion of the volume of liquid, and (iv) a pressure release valve for selectively decreasing the prevailing pressure within the tank.

According to further features, the tank includes a funnel with a downwardly depending tube where the funnel is disposed substantially toward the top of the tank while the tube extends downwards so as to be substantially adjacent the bottom of the tank. The apparatus further includes sensing apparatus for sensing the level of the volume of liquid in the tank.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a cleaning system using balls for cleaning the inside of liquid-conducting tubing and apparatus for injecting a volume of liquid from a source to a liquid-conducting system.

The principles and operation of the cleaning system and the apparatus according to the present invention may be better understood with reference to the drawings and the accompanying description.

Figure 1:
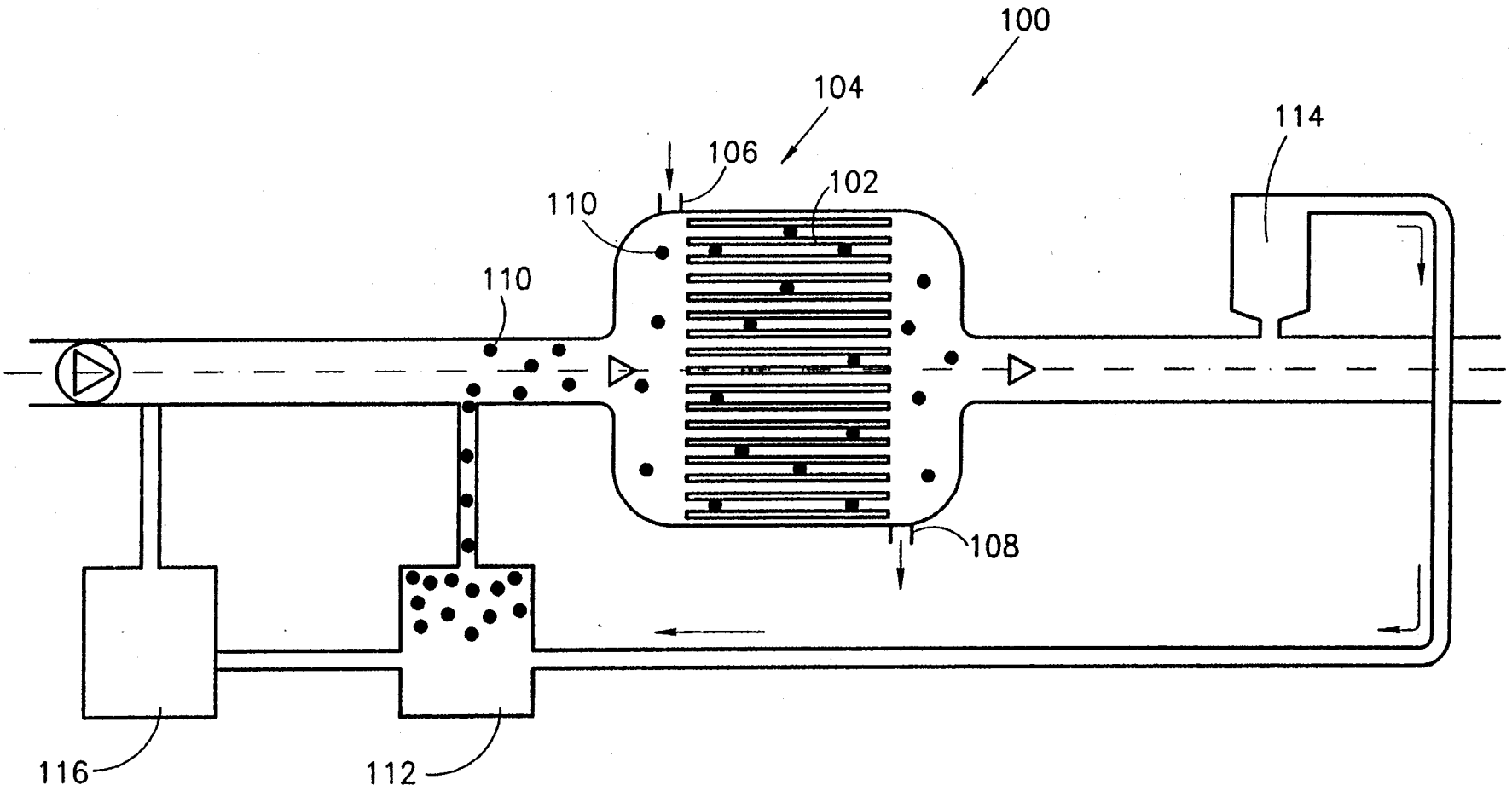
FIG. 1 is a block diagram of a system using balls for cleaning the inside of fluid-conducting tubing including ball recirculation apparatus and liquid recirculation apparatus.

Hence, with reference now to the drawings, FIG. 1 is a block diagram of a system, generally designated 100, according to the teachings of the present invention, using balls for cleaning the inside of liquid-conducting tubing 102 of a condenser 104. Condenser 104 is used for condensing a fluid, such as steam or refrigerant gas, circulated from an inlet 106 through the spaces between tubing 102 to an outlet 108. In order to prevent the lodging or settling of particles within tubing 102, system 100 includes a plurality of balls 110 which are forced through tubing 102 for cleaning same of bacteria and scale as it forms.

Ball recirculation apparatus 112, having an inlet at the downstream side of tubing 102 and an outlet at the upstream side of tubing 102, is used for recirculating balls 110 within system 100. Ball recirculation apparatus 112 can include ball separation apparatus 114, deployed between the downstream side of tubing 102 and the inlet to ball recirculation apparatus 112, for separating balls 110 from the flow of liquid entraining them downstream of tubing 102.

System 100 also includes liquid recirculation apparatus 116 for recirculating at least a portion of the volume of the liquid drained from ball recirculation apparatus 114 after being used for entraining balls 110 to balls recirculation apparatus 112. Hence, liquid recirculation apparatus 116 has an inlet in flow communication with ball recirculation apparatus 112 and an outlet at upstream of tubing 102. Liquid recirculation apparatus 116 can be in the form of a pump or apparatus described now with reference to FIGS. 2*a* and 2*b*.

Figure 2A:
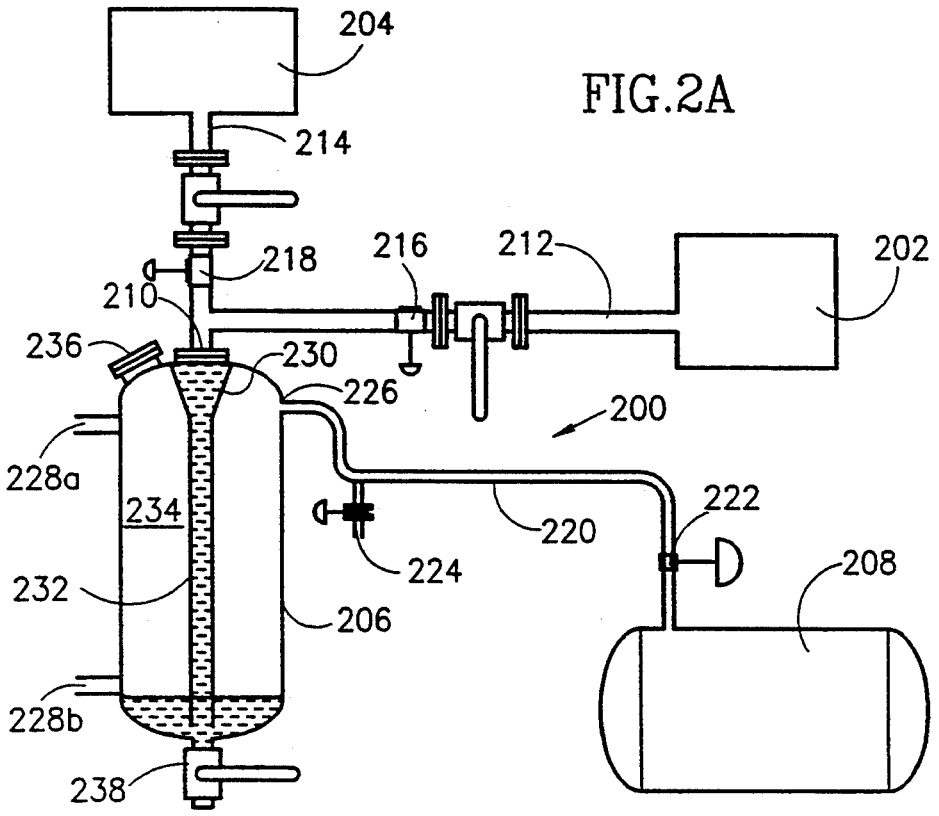
FIGS. 2*a* and 2*b* are schematic views of a preferred embodiment of apparatus for injecting a volume of liquid from a source to a liquid conducting system before and after injection of a volume of liquid.
Figure 2B:
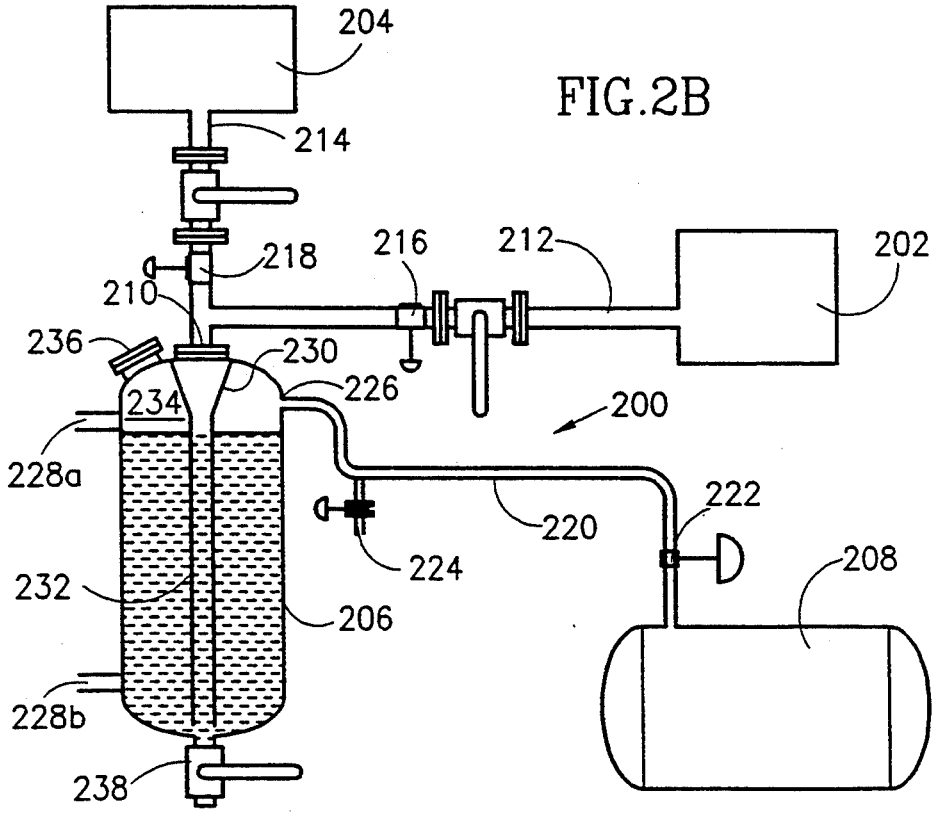
Figure 3:
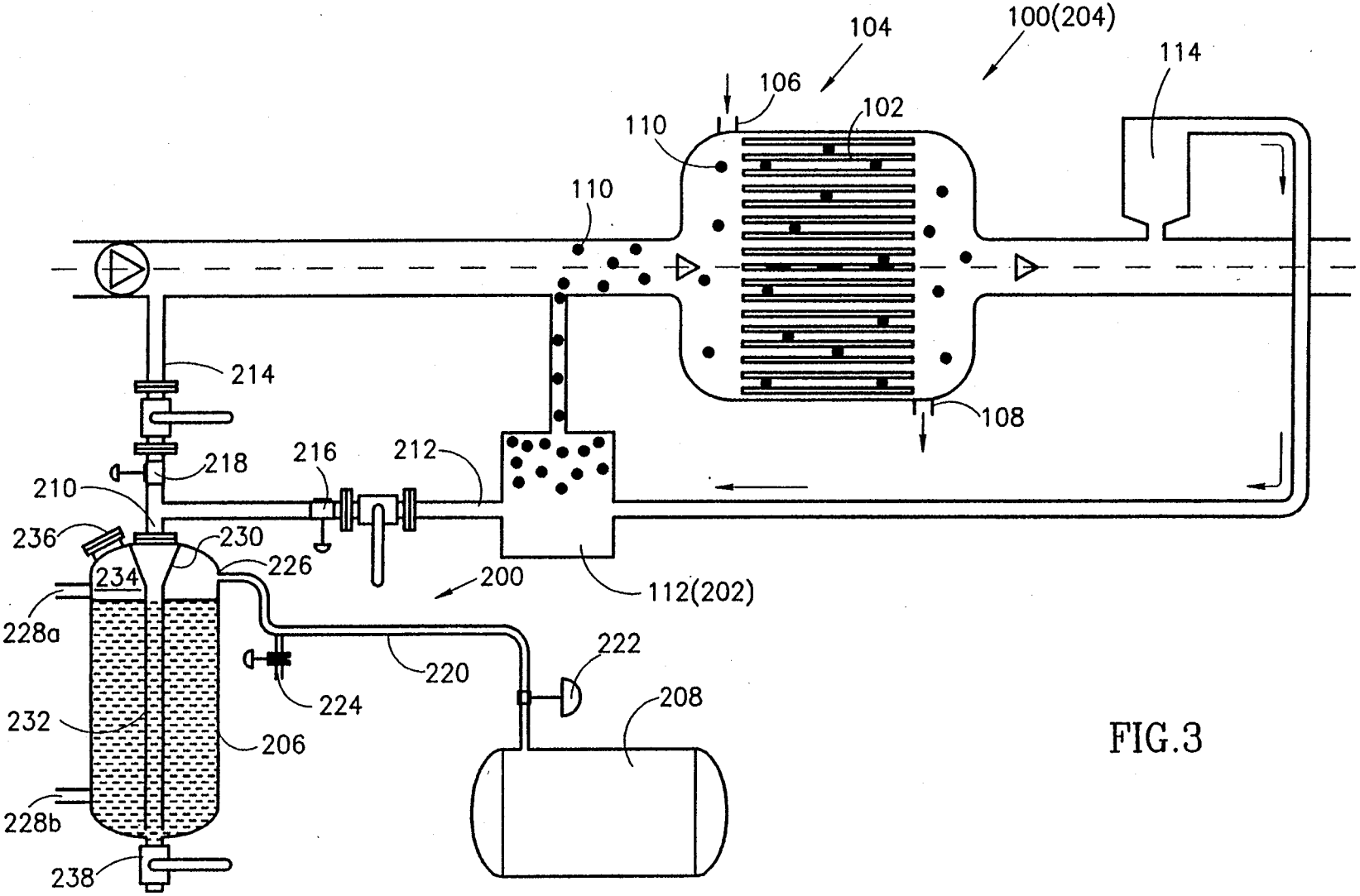
FIG. 3 is a schematic view of a system using balls for cleaning the inside of fluid-conducting tubing including the apparatus for injecting a volume of liquid from a source to a liquid conducting system of FIG. 2.

Turning now to FIGS. 2*a* and 2*a*, there is shown a preferred embodiment of apparatus, generally designated 200, constructed and operative according to the teachings of the present invention, for injecting a volume of liquid received from a source of liquid 202 into a liquid conducting system 204. It can be appreciated that the liquid received from source of liquid 202 can be either homogenous or heterogenous with the liquid flowing in liquid conducting system 204 depending on the particular implementation of apparatus 200. For the sake of exposition, an implementation of apparatus 200 is shown in FIG. 3 in which apparatus 200 is employed for injecting liquid drained from ball recirculation apparatus 112 of tubing 102. In this case, source 202 is in the form of ball recirculation apparatus 112, liquid conducting system 204 is in the form of system 100 and the purpose of injecting a volume of liquid from a source of liquid 202 into a liquid conducting system 204 refers to recirculating liquid drained from ball recirculation apparatus 112 upstream of tubing 102.

Apparatus 200 generally includes a tank 206 for storing a volume of liquid received from source 202 and a compressor 208 for injecting most of the volume of liquid in tank 206 into system 204 as will become apparent below. Tank 206 preferably has a combined inlet/-outlet port 210 through which pass both incoming liquid along inlet line 212 from source 202 and outgoing liquid along outlet line 214 during injection into system 204. Hydraulic one-way valves 216 and 218 are deployed on inlet and outlet lines 212 and 214, respectively, for ensuring the flow of liquid from source 202 to system 204.

Compressor 208 provides a supply of compressed fluid, typically compressed air, via an air line 220 connected to tank 206 at air inlet 226. Air line 220 is fitted with a valve 222 and a pressure release valve 224 for controlling the prevailing pressure in tank 206 by enabling a supply of compressed air from compressor 208 and evacuating air from tank 206, respectively. One-way valves 216 and 218, valve 222 and pressure release valve 224 can be operated in a number of modes of operation for the periodic injection of liquid from tank 206 into system 204. Such modes include according to a pre-determined schedule, in response to indications provided by sensors 228*a* and 228*b* detecting the level of the volume of liquid in tank 206 or manual activation.

In tank 206, a funnel 230 with a downwardly depending tube 232 is attached thereto in a sealed manner, thereby defining an air-tight chamber 234 from which liquid is to be discharged by the action of compressor 208. Tank 206 can be further provided with a viewing glass 236 for enabling observation of the accumulation of liquid therein and a drainage valve 238 for cleaning and other maintenance purposes. It should be noted that the maximum volume of liquid which can be discharged from air-tight chamber 234 is determined by the location and configuration of funnel 230 and the location of air inlet 226. Hence, to maximize the dischargeable or injectable volume of liquid from tank 206, funnel 230 and air inlet 226 are preferably disposed substantially toward the top of tank 206 while tube 232 extends downward so as to be substantially adjacent the bottom of tank 206.

An operation cycle of apparatus 200 is now described with reference to FIGS. 2*a* and 2*a* where FIG. 2*a* shows tank 206 substantially empty while FIG. 2*a* shows tank 206 substantially full of liquid before its injection into system 204. Liquid passes along inlet line 212 through open one-way valve 216 from source 202 and accumulates in tank 206. Typically, valve 222 is closed and pressure release valve 224 is open such that the prevailing pressure in tank 206 is atmospheric. The volume of liquid in air-tight chamber 234 increases until the level of the liquid reaches sensor 228*a* as shown in FIG. 2*a*.

On activation, sensor 228*a* transmits a signal for opening valve 222 and closing pressure release valve 224, thereby establishing flow communication between tank 206 and compressor 208, and closing valve 216 to shut-off the supply of liquid from source 202. Compressor 208 supplies compressed air to tank 206 such that the prevailing pressure in chamber 234 is sufficient to drive the volume of liquid upwards through tube 232 along outlet pipe 214 to system 204.

After tank 206 has been substantially emptied, the level of the liquid in chamber 234 reaches sensor 238*b* as shown in FIG. 2*a*. On activation, sensor 238*b* closes valve 218 and primes apparatus 200 for the next injection of liquid by reducing the prevailing pressure in tank 206 by opening pressure release valve 224 and closing valve 222.

Figure 4A:
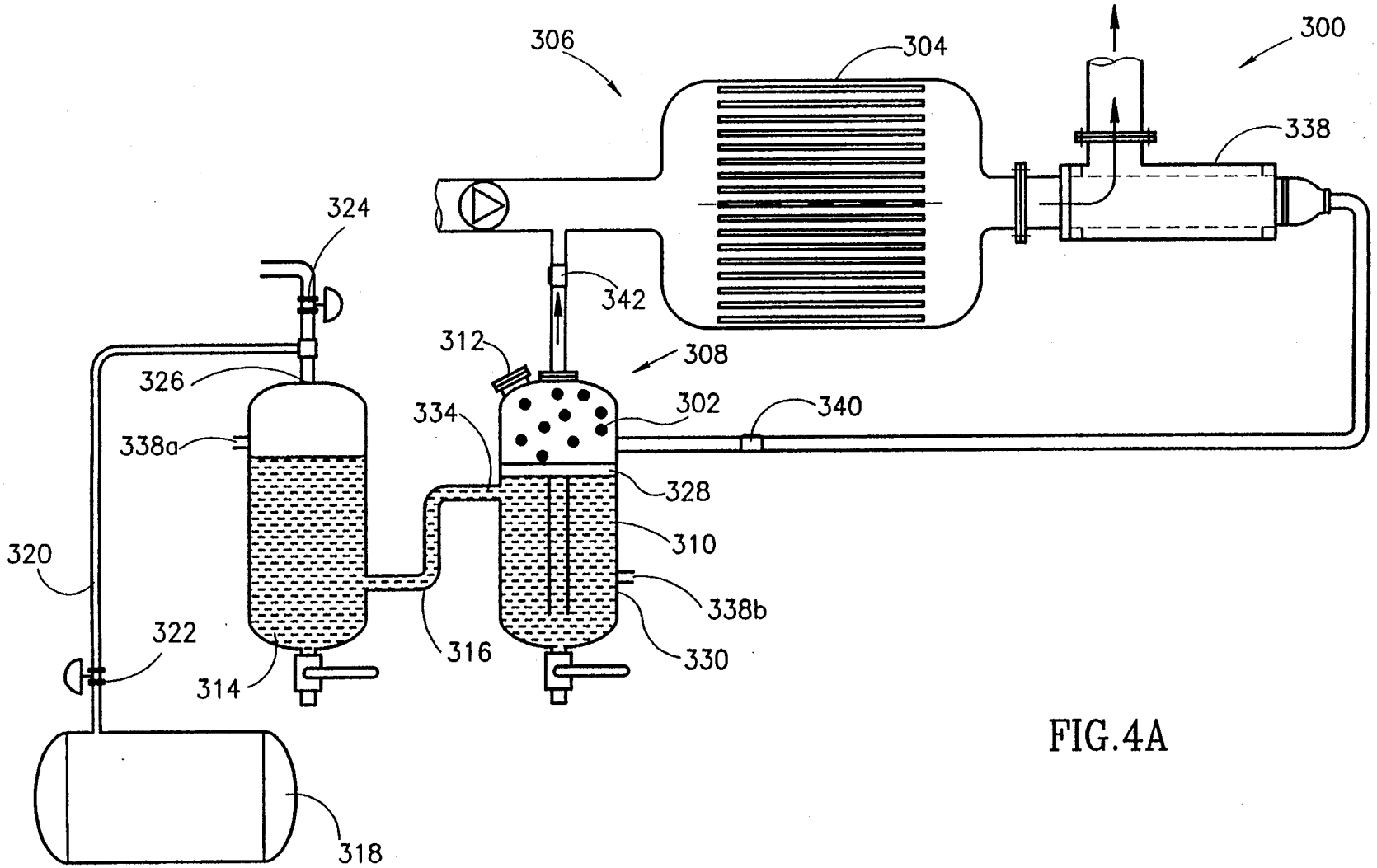
FIGS. 4*a* and 4*b* are schematic views of a preferred embodiment of a system using balls for cleaning the inside of fluid-conducting tubing including recirculation apparatus for recirculating balls and the liquid entraining the balls to the recirculation where the apparatus is shown before its actuation in FIG. 4*a* and after its actuation in FIG. 4*b*.
Figure 4B:
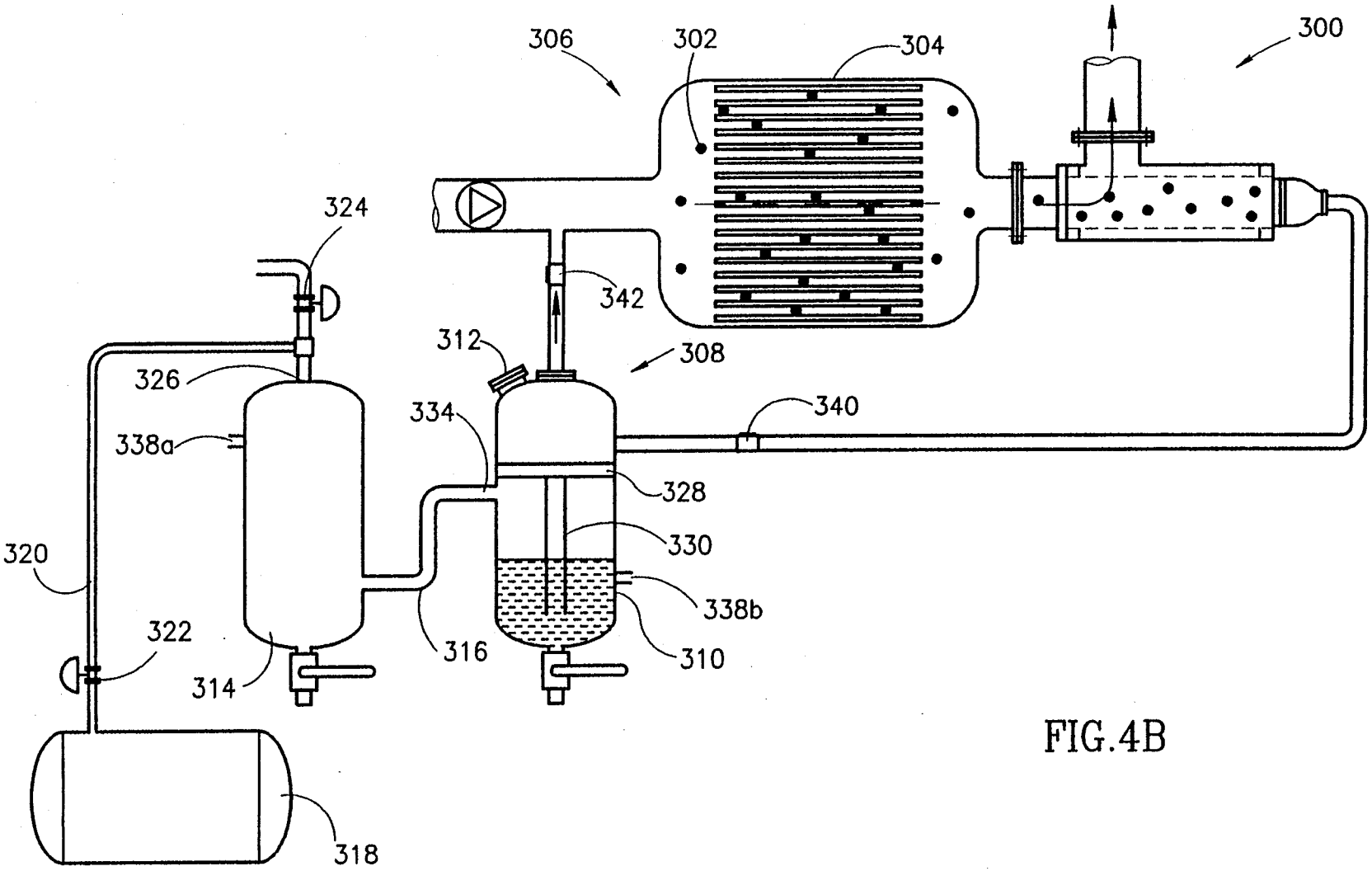

Turning now to FIGS. 4*a* and 4*b*, there is shown a preferred embodiment of a cleaning system, generally designated 300, constructed and operative according to the teachings of the present invention. The construction and operation of cleaning system 300 is similar to the cleaning system disclosed in the co-pending U.S. patent application Ser. No. 08/154,062 filed Nov. 18, 1993. Hence, in short, cleaning system 300 includes balls 302 used for cleaning the inside of liquid conducting tubing 304 of a condenser 306 and recirculation apparatus, generally designated 308, having an inlet at the downstream side of tubing 304 and an outlet at the upstream side of tubing 304.

The main difference between system 300 and the system disclosed in co-pending U.S. patent application Ser. No. 08/154,062 is that the liquid used for entraining balls 302 into recirculation apparatus 308 is also recirculated by recirculation apparatus 308 rather than at least a portion thereof being discharged as waste to a drain. Hence, the storage capacity of tank 310 of recirculation apparatus 308 is increased such that tank 310 has sufficient storage capacity to store all the liquid used for entraining balls 302 into ball trap 312 of recirculation apparatus 308. Alternatively, depending on the particular installation, a second tank 314 can be provided for receiving the overflow from tank 310 through a connection 316.

As before, recirculation apparatus 308 includes a compressor 318 for providing a supply of compressed via an air line 320 fitted with a valve 322 and a pressure release valve 324 connected to, in this case, tank 314 at air inlet 326. Also, tank 310 includes a funnel 328, with a downwardly depending tube 330, attached thereto in a sealed manner, thereby defining an air-tight chamber 334. Funnel 328 is disposed so as to catch the liquid used for entraining balls 302 from ball separation apparatus 336 to ball trap 312. Recirculation apparatus 308 preferably also includes sensors 338*a* and 338*b* used for determining the minimum and maximum volumes of liquid in tank 310.

An operation cycle of system 300 is now described with reference to FIGS. 4*a* and 4*b* where FIG. 4*a* shows recirculation apparatus 308 in a state ready for injection of balls 302 and the volume of liquid in tank 310 upstream of tubing 304 while FIG. 4*b* shows balls 302 dispersed through system 300 after their injection.

Injection of balls 302 in ball trap 312 and the liquid in tank 310 is achieved by activation of compressor 318 providing a supply of compressed air through air supply pipe 320 into tank 310 on opening valve 322 and closing valve 324. The compressed air increases the prevailing pressure in tank 310 such that the liquid in chamber 334 is forced upwards through tube 330 and ball trap 312, thereby entraining balls 302 accumulated therein upstream of tubing 304. At the time of discharge from ball trap 312, the prevailing pressure in tank 310 is greater than both the downstream and upstream pressures of the liquid in tubing 304 causing one way-valve 340 to close and one-way valve 342 to open. Typically, compressor 318 is activated until the level of the volume in tank 310 drops to the level of sensor 338*a* as shown in FIG. 4*b*.

While balls 302 are being forcibly circulated through system 300 in a generally clockwise direction, valve 322 is closed and pressure release valve 324 is opened causing a pressure differential to be developed between the liquid in tubing 304 and the prevailing pressure in tank 310. The pressure differential causes one-way valve 342 to close and one-way valve 340 to open such that the liquid flowing downstream of tubing 304 is diverted to evacuate balls 302 from separation apparatus 338 for delivery to recirculation apparatus 308.

As liquid flows from separation apparatus 338, balls 302 are accumulated in ball trap 312 while the volume of liquid entraining them is captured by funnel 328 for storage in tank 310. Typically, the flow of liquid is maintained until all the balls 302 are accumulated in ball trap 312 or until the level of the volume of liquid reaches sensor 338*b* as shown in FIG. 4*a*.

While the invention has been described with respect to a limited number of embodiments, it will be appreciated that many variations, modifications and other applications of the invention may be made.

What is claimed is:

1. A cleaning system for cleaning liquid-conducting tubing, comprising:

(a) a plurality of balls;

(b) ball recirculation apparatus having an inlet at the downstream side of the tubing for receiving liquid entraining a portion of said plurality of balls, a ball outlet at the upstream side of the tubing, and a drain liquid outlet for draining some of said liquid entraining said portion of said plurality of balls, said ball recirculation apparatus recirculating some of said portion of said plurality of balls upstream of the tubing via said ball outlet; and (c) liquid recirculation apparatus having an inlet in flow communication with said drain liquid outlet for receiving a fraction of said liquid entraining said portion of said plurality of balls to said ball recirculation apparatus and an outlet at the upstream side of the tubing, said liquid recirculation apparatus recirculating some of said fraction of said liquid drained from said ball recirculation apparatus upstream of the tubing via said outlet.

2. The system as in claim 1, wherein said liquid recirculation apparatus includes a compressor for selectively providing a supply of compressed air.

3. The system as in claim 2, wherein said liquid recirculation apparatus includes a tank having:

(i) a liquid inlet port selectively in flow communication with said ball recirculation apparatus, (ii) a liquid outlet port selectively in flow communication with the tubing, (iii) an air inlet pipe selectively in flow communication with said compressor, and (iv) a pressure release valve for selectively decreasing the pressure within said tank.

4. The system as in claim 3, wherein said tank includes a funnel with a downwardly depending tube.

5. The system as in claim 4, wherein said funnel is disposed substantially toward the top of said tank.

6. The system as in claim 4, wherein said tube extends downwards so as to be substantially adjacent the bottom of said tank.

7. The system as in claim 1, further comprising sensing means for sensing the level of the volume of liquid in said tank.

8. Apparatus for injecting a volume of liquid received from a source of liquid into a liquid conducting system, said apparatus comprising:

(a) a compressor for selectively providing a supply of compressed gas; and (b) a tank including:

(i) a liquid inlet port selectively in flow communication with the source of the liquid for receiving a volume of liquid, (ii) a liquid outlet port selectively in flow communication with the liquid conducting system for delivering at least a portion of said volume of liquid, (iii) an air inlet port selectively in flow communication with said compressor for increasing the prevailing pressure in said tank so as to discharge said at least a portion of said volume of liquid, and (iv) a pressure release valve for selectively decreasing the prevailing pressure within said tank.

9. The apparatus as in claim 8, wherein said tank includes a funnel with a downwardly depending tube.

10. The apparatus as in claim 9, wherein said funnel is disposed substantially toward the top of said tank.

11. The apparatus as in claim 9, wherein said tube extends downwards so as to be substantially adjacent the bottom of said tank.

12. The apparatus as in claim 8, further comprising sensing means for sensing the level of the volume of liquid in said tank.

* * * * *